US007896439B2

(12) United States Patent
Kan et al.

(10) Patent No.: US 7,896,439 B2
(45) Date of Patent: Mar. 1, 2011

(54) CHAIR

(75) Inventors: Satoshi Kan, Osaka (JP); Eric Chan, New York, NY (US)

(73) Assignee: Itoki Corporation, Osaka-shi, Osaka (JP)

( * ) Notice: Subject to any disclaimer, the term of this patent is extended or adjusted under 35 U.S.C. 154(b) by 83 days.

(21) Appl. No.: 12/439,076

(22) PCT Filed: Aug. 30, 2006

(86) PCT No.: PCT/JP2006/317079

§ 371 (c)(1),
(2), (4) Date: Feb. 26, 2009

(87) PCT Pub. No.: WO2008/026264

PCT Pub. Date: Mar. 6, 2008

(65) Prior Publication Data

US 2009/0236890 A1 Sep. 24, 2009

(51) Int. Cl.
*A47C 3/025* (2006.01)
*A47C 3/026* (2006.01)

(52) U.S. Cl. ..... 297/286; 297/285; 297/291; 297/296; 297/297

(58) Field of Classification Search ..... 297/285, 297/286, 291, 297, 292, 296
See application file for complete search history.

(56) References Cited

U.S. PATENT DOCUMENTS 503,319 A * 8/1893 Herrick ..... 297/286
2,532,025 A * 11/1950 Johnson ..... 297/286
2,617,471 A * 11/1952 Anton ..... 297/87
2,838,095 A * 6/1958 Deaton ..... 297/301.4
3,083,999 A * 4/1963 Silva ..... 297/286
3,907,363 A * 9/1975 Baker et al. ..... 297/450.1
4,131,315 A * 12/1978 Vogtherr ..... 297/286

(Continued)

FOREIGN PATENT DOCUMENTS

DE 3203042 A1 * 10/1982

(Continued)

*Primary Examiner*—Rodney B White
(74) *Attorney, Agent, or Firm*—Drinker Biddle & Reath LLP

(57) ABSTRACT

A chair has a seat 1 and a backrest 2 and the backrest 2 is allowed to be tilted backward by elastic deformation of right and left back frame devices 4. The right and left back frame devices 4 each are composed of two unit frames 43 and 44. The back frame device 4 has a main portion 4*a* which are disposed outside the right and left sides of the seat 1, upper inward portions 43*a* and 44*a* which are connected to an upper rear end of the main portion 4*a*, lower inward portions 43*b* and 44*b* which go under the seat 1 from a lower end portion of the main portion 4*a*, and forward end portions 43*c* and 44*c* which are integrally connected to the lower inward portions 43*b* and 44*b*. The forward end portions 43*c* and 44*c* are fixed to the base 7. The back frame device 4 can be largely elastically deformed with the combination of a characteristic in which the back frame device is long, a characteristic in which the back frame device has the lower inward portions 43*b* and 44*b*, and a characteristic in which the back frame device has the forward end portions 43*c* and 44*c*. Accordingly, the backrest 2 can be tilted backward at a large angle.

14 Claims, 13 Drawing Sheets

U.S. PATENT DOCUMENTS 4,429,917 A * 2/1984 Diffrient ..... 297/300.5
4,451,085 A * 5/1984 Franck et al. ..... 297/285 X
4,522,444 A * 6/1985 Pollock ..... 297/288 X
4,533,177 A * 8/1985 Latone ..... 297/285 X
4,560,199 A * 12/1985 Sapper ..... 297/323
4,641,885 A * 2/1987 Brauning ..... 297/292 X
4,703,974 A * 11/1987 Brauning ..... 297/285
4,732,424 A * 3/1988 Uredat-Neuhoff ..... 297/292 X
4,783,121 A 11/1988 Luyk et al.
4,832,406 A * 5/1989 Adams et al. ..... 297/411.33
4,834,453 A * 5/1989 Makiol ..... 297/300.4
4,840,426 A * 6/1989 Vogtherr et al. ..... 297/300.5
4,889,385 A * 12/1989 Chadwick et al. ..... 297/286 X
4,911,501 A * 3/1990 Decker et al. ..... 297/285 X
4,971,394 A * 11/1990 Vanderminden ..... 297/286 X
4,988,145 A * 1/1991 Engel ..... 297/286 X
5,009,466 A * 4/1991 Perry ..... 297/323
5,029,940 A * 7/1991 Golynsky et al. ..... 297/300.4
5,046,780 A 9/1991 Decker et al.
5,114,212 A * 5/1992 Verney et al. ..... 297/411.44 X
5,314,237 A * 5/1994 Koepke et al. ..... 297/318
5,318,346 A * 6/1994 Roossien et al. ..... 297/300.1
5,338,094 A * 8/1994 Perry ..... 297/286 X
5,540,481 A * 7/1996 Roossien et al. ..... 297/300.4
5,630,643 A * 5/1997 Scholten et al. ..... 297/218.2
5,662,381 A * 9/1997 Roossien et al. ..... 297/301.1
5,842,264 A * 12/1998 Roossien et al. .... 297/411.28 X
5,887,946 A * 3/1999 Raftery ..... 297/297
5,909,923 A * 6/1999 DeKraker ..... 297/285
5,988,746 A * 11/1999 Raftery ..... 297/297
6,070,937 A * 6/2000 Ginat ..... 297/286 X
6,102,477 A * 8/2000 Kurtz ..... 297/301.7
6,109,694 A * 8/2000 Kurtz ..... 297/320
6,116,688 A * 9/2000 Wilkerson et al. ..... 297/316
6,120,097 A * 9/2000 Perry et al. ..... 297/325
6,296,309 B1 * 10/2001 Kurtz ..... 297/297
6,367,877 B1 * 4/2002 Knoblock et al. ..... 297/301.1
6,386,634 B1 * 5/2002 Stumpf et al. ..... 297/300.4
6,394,549 B1 * 5/2002 DeKraker et al. ..... 297/342
6,425,633 B1 * 7/2002 Wilkerson et al. ..... 297/300.2
6,517,158 B1 * 2/2003 Wang ..... 297/411.36
6,523,895 B1 * 2/2003 Vogtherr ..... 297/291 X
6,523,898 B1 * 2/2003 Ball et al. ..... 297/320
6,568,760 B2 * 5/2003 Davis et al. ..... 297/440.14
6,588,845 B2 * 7/2003 Wilkerson et al. ..... 297/300.2
6,685,267 B1 * 2/2004 Johnson et al. ..... 297/300.1
6,820,936 B2 * 11/2004 Wilkerson et al. ..... 297/286 X
6,896,328 B2 * 5/2005 Goodworth ..... 297/297 X
6,913,315 B2 * 7/2005 Ball et al. ..... 297/284.7
6,966,604 B2 * 11/2005 Stumpf et al. ..... 297/300.2
6,991,291 B2 * 1/2006 Knoblock et al. ..... 297/284.4
7,040,709 B2 * 5/2006 Knoblock et al. ..... 297/300.2 X
7,114,777 B2 * 10/2006 Knoblock et al. ..... 297/342
7,131,700 B2 * 11/2006 Knoblock et al. ..... 297/452.31
7,147,282 B2 * 12/2006 Hatcher et al. ..... 297/300.2 X
7,188,900 B1 * 3/2007 Raftery ..... 297/286
7,234,775 B2 * 6/2007 Serber ..... 297/301.1
7,267,405 B2 * 9/2007 Tin ..... 297/300.2
7,273,253 B2 * 9/2007 Deimen et al. ..... 297/300.4
7,427,105 B2 * 9/2008 Knoblock et al. ..... 297/322
7,478,880 B2 * 1/2009 Johnson et al. ..... 297/342
7,484,803 B2 * 2/2009 Dozsa-Farkas ..... 297/320
7,488,040 B2 * 2/2009 Dozsa-Farkas ..... 297/317
7,625,045 B2 * 12/2009 Hatcher et al. ..... 297/300.2
2003/0047982 A1 * 3/2003 Ball et al. ..... 297/452.29
2003/0127896 A1 * 7/2003 Deimen et al. ..... 297/301.1
2003/0137171 A1 * 7/2003 Deimen et al. ..... 297/300.1 X
2005/0194823 A1 9/2005 Perry et al.
2006/0244294 A1 * 11/2006 Dozsa-Farkas ..... 297/300.2

FOREIGN PATENT DOCUMENTS

JP 390617 9/1947
JP 3-23810 1/1991
JP 8-15446 2/1996
JP 9-502631 3/1997
JP 2005-211668 8/2005

* cited by examiner

FIG. 5B
FIG. 5A
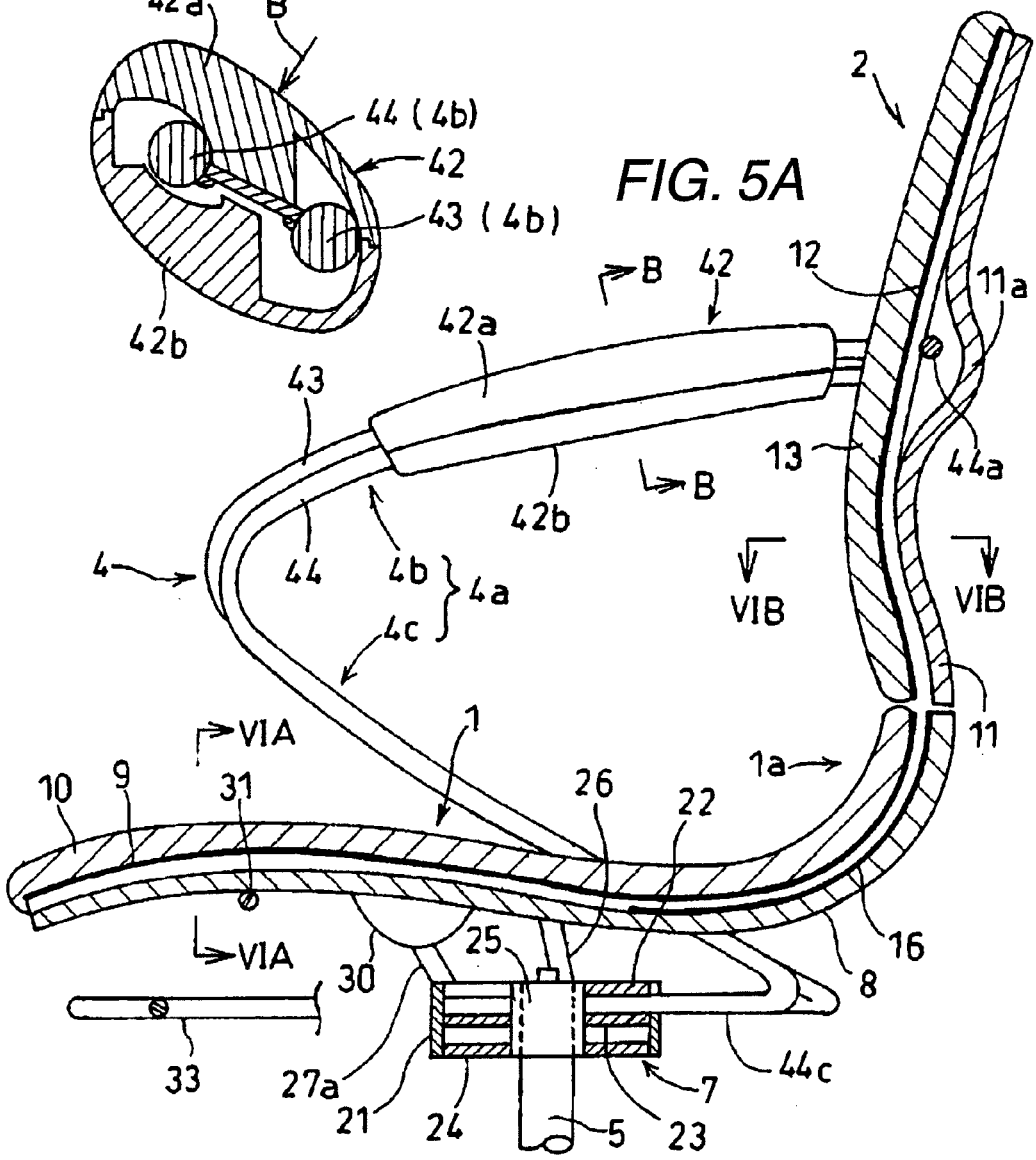
FIG. 6A
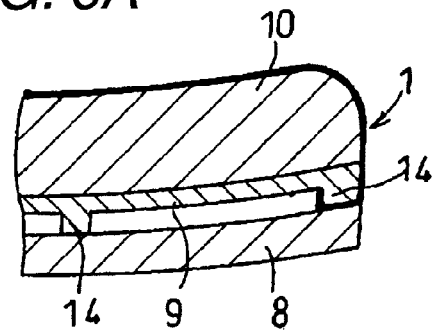
FIG. 6B
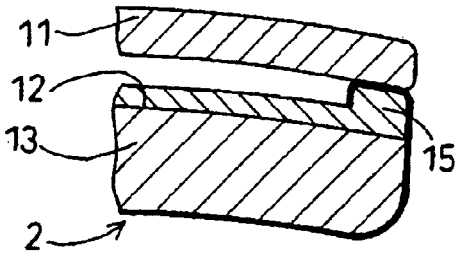

FIG. 7A
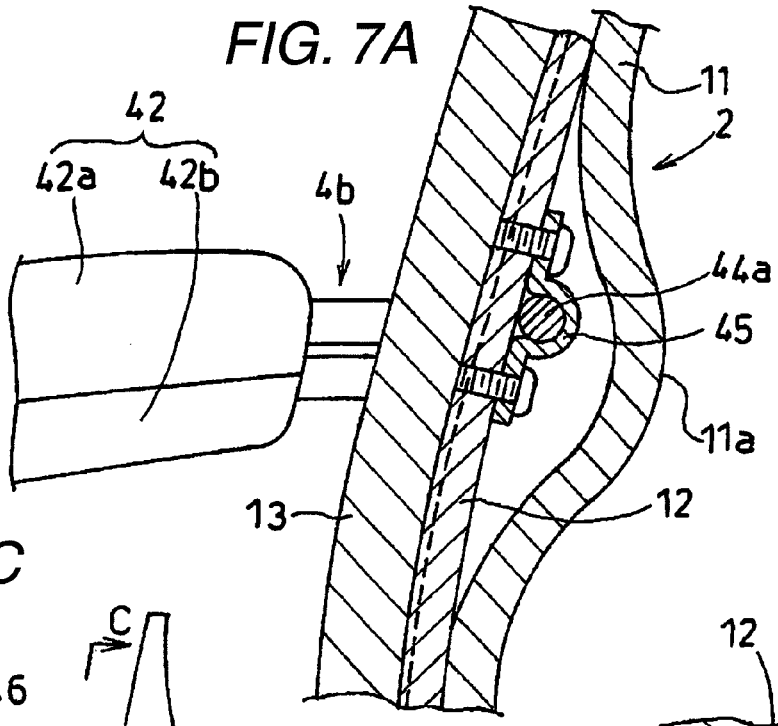
FIG. 7C
FIG. 7B
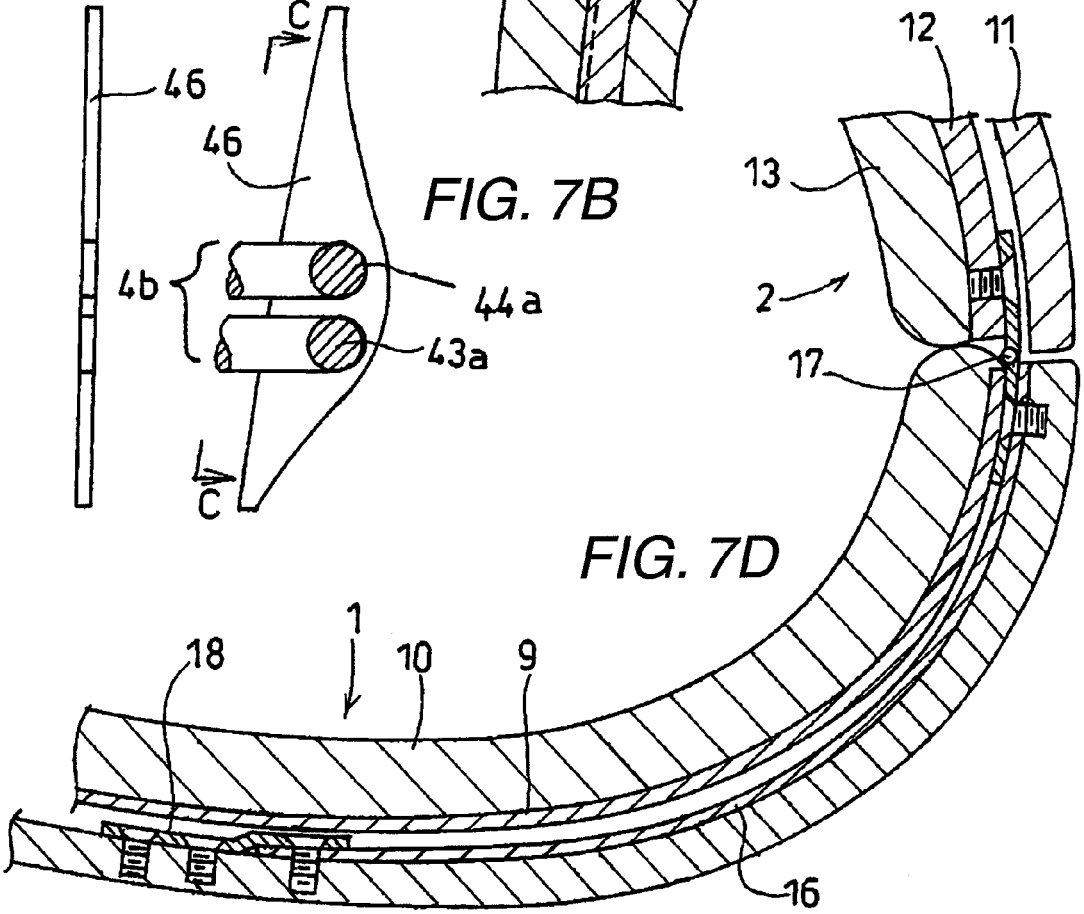
FIG. 7D

CHAIR

TECHNICAL FIELD

The present invention relates to a chair with a backrest supported by a frame.

BACKGROUND ART

As a chair having a relatively simple structure, there is a chair in which a backrest is attached to a frame device including bars or pipes. The chair of this type is allowed to have a rocking function so that the backrest is tilted backward by the leaning of a person sitting on a seat. An example thereof is described in Patent Document 1.

That is, in Patent Document 1, a frame device of a chair includes right and left lower horizontal portions which elongates in back and forth directions and placed on a floor, right and left front legs which rise toward the upper side from front ends of the lower horizontal portions, upper horizontal portions which extend to the rear side from upper ends of the right and left front legs, and right and left rear legs which rise from rear ends of the lower horizontal portions, and a seat is attached to the right and left upper horizontal portions.

Rear ends of the right and left upper horizontal portions rise toward the upper side and the right and left upper horizontal portions are integrally connected to each other at a horizontally long lower portion. The horizontally long portion is connected to a lower back face of a backrest. Further, the upper ends of the right and left rear legs are connected to each other by a horizontally long upper portion and the horizontally long upper portion is connected to a back face of a mid-height portion of the backrest. The backward tilting of the backrest of the chair in Patent Documents 1 is realized because the rear legs resist elasticity and are thus tilted backward, mainly.

Meanwhile, Patent Document 2 describes an example of a rotating chair which has a leg column formed of a gas cylinder and in which a seat and a backrest are supported by a frame device. Further, in a chair disclosed in Patent Document 3, a frame device has a shape opened toward the rear side in a side view and is fixed to a base, and a backrest is attached to a rear portion of the frame device.

Patent Document 1: Japanese Patent Publication No. 8-15446

Patent Document 2: Japanese Translation of PCT Application No. 9-502631

Patent Document 3: Japanese Registered Design Publication No. 390617

DISCLOSURE OF THE INVENTION

Problem that the Invention is to Solve

In order to improve comfort in a rocking state, it is effective that a backrest is tilted backward as much as possible. Accordingly, in the case of a chair in which a backrest is rocked using elastic deformation of a frame, it is required to largely deform the frame as much as possible. However, in the case of the chair in Patent document 1, since only the rear legs of the frame are elastically deformed, a backward tilting amount of the backrest is small and a problem occurs in that there is a limit on improvement of comfort in a rocking state.

In addition, it can be said that, in the chair in Patent Document 2, a rocking function using bending of the frame device is rarely expected because the seat and the backrest only slide in back and forth directions as a whole. Further, it is not known whether the chair in Patent Document 3 has a rocking function.

The present invention is contrived in view of the problems and a main object of the invention is to provide a chair which can ensure an improved rocking function together with a simple structure.

A chair of the present invention has a seat which is supported by a base, a backrest which is tiltable backward, and back frame devices which have main portions positioned outside the right and left sides of the seat and support the backward tilting of the backrest. The backward tilting of the backrest is allowed by elastic deformation of the back frame devices.

As a character of the present invention, the main portions of the right and left back frame devices have a shape opened toward the rear side in a side view. In addition, as another character of the present invention, an upper connecting portion to which the backrest is attached is provided at an upper rear end of the main portion of the back frame device, a lower connecting portion going under the seat is formed integrally with a lower rear end of the main portion of the back frame device, the lower connecting portion has an end portion extending to the front side, and the end portion of the lower connecting portion is fixed to the base or the seat.

In the present invention, the main portion of the back frame device can be replaced with the word "side frame" to adopt a representation method that the side frame is provided with an upper connecting portion and a lower connecting portion.

In the present invention, the whole back frame device can be elastically tilted. Further, since the main portion of the back frame device has a shape opened toward the rear side in a side view, a total length of the back frame device is long. A deformation amount of the back frame device can be increased because of the shape of the main portion. This is a first functional characteristic of the present invention.

In addition, a screwing action and a bending action are applied to the lower connecting portion forming a lower portion of the back frame device upon rocking and thus the lower connecting portion is easily elastically deformed. This is a second functional characteristic of the present invention.

In the present invention, the back frame device can be largely elastically deformed with the combination of the characteristics. As a result, it is possible to ensure an improved rocking function together with a simple structure.

The "base" in the present invention represents a member supporting the seat and thus a leg is also in a category of the base. When the leg includes a gas cylinder, it is thought that the base is fixed to an upper end of the gas cylinder and the leg and the base are different members. However, when the leg is formed of a pipe or a plate, the seat and the back frame device can be attached to the leg, and thus in this case, the leg and the base are identifiable.

The present invention has various variations and these will be described as follows.

(1). Variation in Relationship between Backrest and Seat

The present invention includes two configurations. One is that the seat and the backrest are integrally connected to each other, and the other is that the seat and the backrest are not connected. When the seat and the backrest are connected to each other, the backrest is supported by the seat and thus a burden on the back frame device is reduced. Accordingly, it can be said that the present invention is particularly valuable in a chair of a type in which the seat and the backrest are integrally connected to each other.

Regardless of the connection between the seat and the backrest, there is a high tendency to improve a fitting property to a body when the seat is tilted backward upon rocking. Moreover, the present invention also includes a configuration in which the seat and the backrest are tilted backward together in a state of being connected to each other. The backrest and the seat are integrally tilted backward in this configuration and thus a comfortable rocking state can be provided to a user. It is preferable that a degree of the backward tilting of the seat is smaller than a degree of the backward tilting of the backrest.

In one configuration of the present invention, a rising portion supporting a waist of a person sitting on the seat is formed at a rear end of the seat and the backrest is connected to the rising portion to be tiltable backward. Under this configuration, the waist of the person is supported by the rising portion of the seat even in a rocking state and thus a so-called lumbar support function can be ensured.

(2). Variation in Structure of Back Frame Device

The structure of the backrest attachment to the back frame device can employ various modes. For example, a bracket may be provided at right and left ends of the backrest to be connected to the upper rear end of the main portion of the back frame device by pins.

In one configuration of the present invention, upper inward portions which extend along a back face of the backrest are formed to be bent at the upper rear ends of the main portions of the right and left back frame devices, respectively, and the upper inward portions serve as the upper connecting portion. This invention has an advantage in that the structure is simple and the backrest can be strongly supported.

The right and left back frame devices each can be formed of one member. However, in a preferable mode of the present invention, the right and left back frame devices each includes a plurality of unit frames extending substantially parallel to each other. The back frame device of the present invention is bent complicatedly as a whole. Accordingly, when the right and left back frame devices each includes a plurality of unit frames, a phenomenon in which the unit frames are deformed restrictively each other occurs and thus it is possible to prevent excessive deformation even when employing thin members (bar-shaped members or pipes). This is an advantage of the present invention.

When the right and left back frame devices each includes a plurality of unit frames, it is preferable that each back frame device is composed of two unit frames in view of appearance and economy. Further, it is preferable to employ metal bars or pipes as a material for the unit frame, and particularly, it is preferable to employ steel or stainless round bars in view of strength.

In the present invention, an armrest can be attached to an upper portion of the main portion of the back frame device. That is, the back frame device also serves as an armrest support member and this is economical. In one configuration of the present invention, under the assumption that the right and left back frame devices each includes two unit frames, the two unit frames extend substantially parallel to each other in the main portion in a top view and in a front view, and the armrest is attached to an upper portion of the main portion. Thanks to this configuration, the armrest can be stably attached.

Further, in another configuration of the present invention, in the attachment of the armrest to the two unit frames of the back frame device, the two unit frames are disposed at different heights so that the unit frame close to the seat is lower than the unit frame distant from the seat. Thus, an upper face of the armrest has a posture obliquely tilted downward toward the seat in a front view. The upper face of the armrest can have a horizontal posture. However, when the upper face of the armrest is tilted downward toward the seat while a person sitting on the seat outstretches his right and left arms (that is, the arms are tilted outside in a front view) and puts each elbow on the armrest, the elbow is put on the upper face of the armrest at nearly 90 degrees and thus stability of the elbows becomes good. This is also an advantage of the present invention.

Furthermore, in another configuration of the present invention, the main portion of the back frame device has a substantially horizontally directed V-shape, in a side view, in which a backward tilting portion and a forward tilting portion are continuously connected to each other. In this configuration, excessive deformation of the main portion is suppressed and thus a proper elastic characteristic can be ensured. In addition, since a space opened toward the front side in a side view is generated between the main portion of the back frame device and the seat, there is an advantage in that, for example, the back frame device does not interfere with even a person who sits on the seat and stretches out his legs. Moreover, the main portion of the back frame device is a most appealing portion. When the main portion is formed in a horizontal V-shape, it gives a sharp impression to people and thus it can be said that this is excellent in view of design.

(3). Variation in Cross-Section Structures of Backrest and Seat

In the present invention, the backrest and the seat include both of a single layer structure and a multilayer structure. In one configuration of the present invention, the backrest has a back inner shell of which a front face is covered with a cushion and a back outer shell which is disposed on the back side of the back inner shell, and the upper inward portion of the back frame device is disposed between the back inner shell and the back outer shell. The chair of the invention has a good appearance because the upper inward portion of the back frame device is not exposed.

Further, in another configuration of the present invention, the back outer shell of the backrest is formed of a wooden plate, and in the back outer shell, a backward protruding portion for avoiding the interference with the upper inward portion of the back frame device is formed to be bent and extends over the entire horizontal length. The seat has a seat outer shell which is formed of a wooden plate and a seat inner shell which is disposed on an upper face thereof and covered with a cushion, and the seat outer shell and the back outer shell have substantially the same thickness and extend to be continuous each other in a side view.

The reason why the back outer shell and the seat outer shell are formed of a wooden plate is mainly requirement in design and cost. Using wood which is a recyclable resource is helpful in view of global environment. Since the outer shell of the backrest is provided with the backward protruding portion, the outer shell and the inner shell of the backrest are brought in contact with each other as closely as possible and the interference of the back frame device with the outer shell is avoided. Thus, an excellent appearance is obtained.

The present invention will be better understood through the following specific examples.

BRIEF DESCRIPTION OF THE DRAWINGS

FIG. 5A is a longitudinal sectional side view and FIG. 5B is a sectional view taken along the line B-B of the longitudinal sectional side view in FIG. 5A;

FIG. 6A is a sectional view taken along the line VIA-VIA in FIG. 5A and FIG. 6B is a sectional view taken along the line VIB-VIB in FIG. 5(A);

FIG. 7A is a sectional view taken along the line VIIA-VIIA in FIG. 2B, FIG. 7B is a side view of a cap, FIG. 7C is a view taken along the line C-C in FIG. 7B, and FIG. 7D is a sectional view taken along the line VIIB-VIIB in FIG. 2B;

DESCRIPTION OF REFERENCE NUMERALS AND SIGNS

Figure 1A:
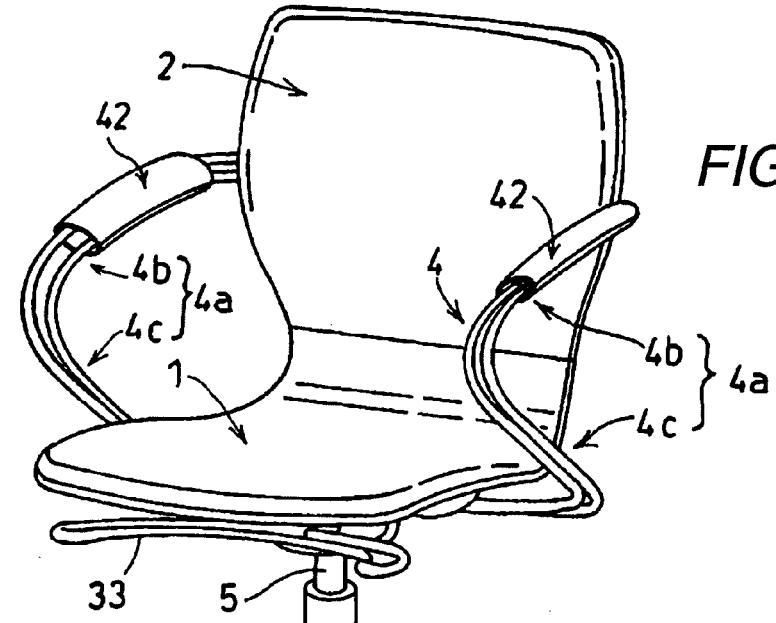
FIG. 1A is a perspective view of a chair of a first embodiment as viewed from the front and FIG. 1B is a perspective view of the chair as viewed from the back.
Figure 1B:
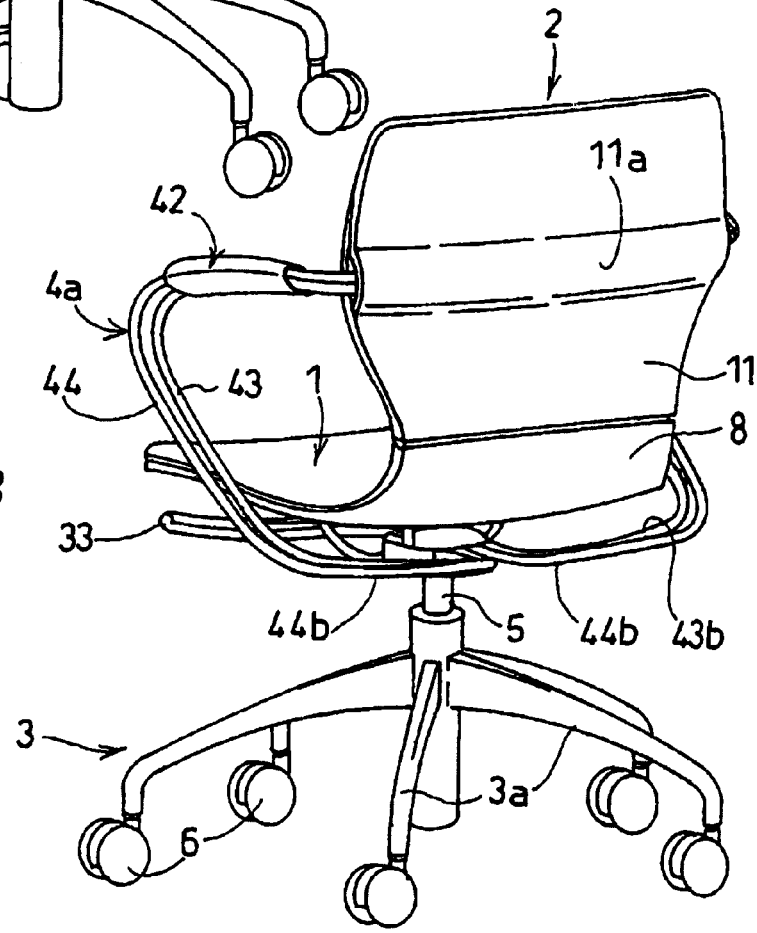

1: SEAT
2: BACKREST
3: LEG
4: BACK FRAME DEVICE
4*a*: MAIN PORTION OF BACK FRAME DEVICE
7: BASE
8: SEAT OUTER SHELL
9: SEAT INNER SHELL
10: SEAT CUSHION
11: BACK OUTER SHELL
12: BACK INNER SHELL
13: BACK CUSHION
17: HINGE
43: FIRST UNIT FRAME
44: SECOND UNIT FRAME
43*a*, 44*a*: UPPER INWARD PORTION AS ONE EXAMPLE OF UPPER CONNECTING PORTION
43*b*, 44*b*: LOWER INWARD PORTION CONSTITUTING LOWER CONNECTING PORTION
43*c*, 44*c*: FORWARD END PORTION CONSTITUTING LOWER CONNECTING PORTION

BEST MODE FOR CARRYING OUT THE INVENTION

First Embodiment

A first embodiment is applied to a so-called rotating chair. The chair has a seat 1 and a backrest 2 which are integrally connected to each other, a leg 3 which supports the seat and the backrest, and right and left back frame devices 4 for holding the backrest 2 to be rocked. The leg 3 has a plurality of branch feet 3*a* radially extending in a top view and a leg column 5 formed of a gas cylinder, and a caster 6 is provided at a front end of the branch foot 3*a*. A base 7 having a circular shape when viewed in a downward direction is fixed to an upper end of the leg column 5. The shape of the base 7 is not limited to the circular shape and any shape can be selected.

For example, as illustrated in FIG. 5A, the seat 1 has a seat outer shell 8 made of plywood (wooden board), a resin seat inner shell 9 overlapping with an upper face of the seat outer shell 8 and fixed thereto, and a seat cushion 10 covering an upper face of the seat inner shell 9.

The backrest 2 has a back outer shell 11 made of plywood (wooden board), a back inner shell 12 disposed in front of the back outer shell, and a back cushion 13 covering a front face of the back inner shell 12. Needless to say, the cushions 10 and 13 are covered with cloth (outer cover material). Any of resin and metal can be employed as a material for the back inner shell 12. In the case where it is required to ensure strength, it is preferable to employ metal (for example, sheet metal or aluminum die-casting product).

Figure 2A:
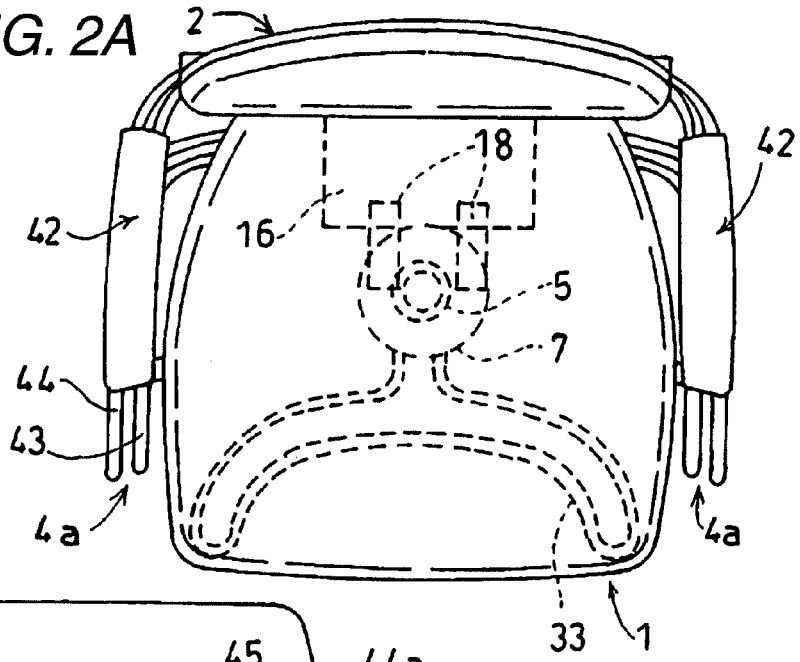
FIG. 2A is a top view of the chair.
Figure 2B:
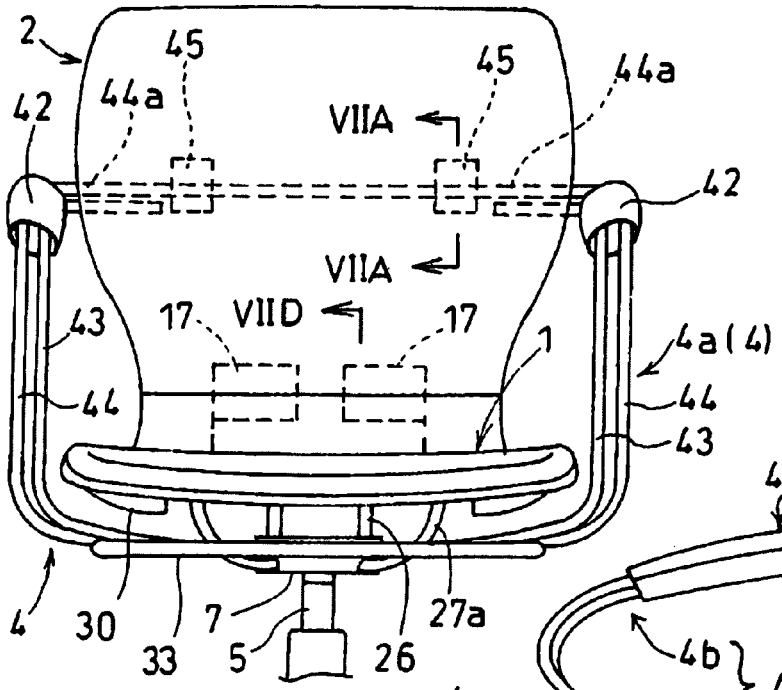
FIG. 2B is a front view of the chair.
Figure 2C:
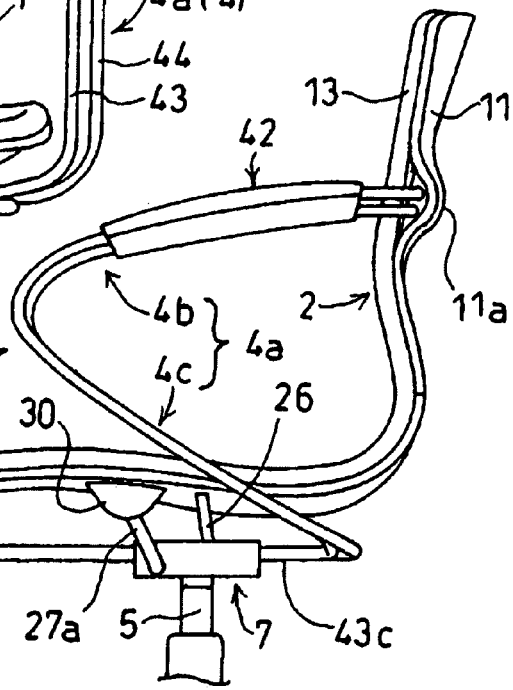
FIG. 2C is a right side view of the chair.

The seat inner shell 9 and the back inner shell 12 are provided with ribs 14 and 15 overlapping with the outer shells 8 and 11, respectively. The seat outer shell 8 and the back outer shell 11; and the seat inner shell 9 and the back inner shell 12 are manufactured as different members, respectively. As illustrated in FIGS. 2A, 2B and 7D, a reinforcing plate 16 made of a thin metal plate is fixed to a rear lower face of the seat outer shell 8 and the reinforcing plate 16 and the back inner shell 12 are connected by a hinge 17 to be rotatable relative to each other. A front end portion of the reinforcing plate 16 is fixed to the seat outer shell 8 by a presser plate 18 made of a metal plate.

The seat outer shell 8 and the back inner shell 12 may be directly connected by the hinge 17 without the use of the reinforcing plate 16. In addition, the seat inner shell 9 and the back inner shell 12 may be connected by the hinge and the seat inner shell 9 and the back outer shell 11 may be also connected by the hinge. Moreover, the seat inner shell 9 and the back inner shell 12 may be also manufactured to be integral with each other (in this case, it is preferable to form a flexible hinge portion).

The seat inner shell 9 and the seat outer shell 8; and the back inner shell 12 and the back outer shell 11 are held to be integral with each other, respectively, by a pair of male and female snap members fitted to each other by deformation occurring against elasticity. Needless to say, they may be fixed to each other by a fastening tool such as a machine screw.

A rear portion of the seat inner shell 9 and a rear portion of the seat outer shell 8 slightly rise while gently curved in a side view (in FIG. 5A, reference sign 1*a* is the rising portion of the seat 1). Accordingly, it can be said that a lower portion of the backrest 2 is configured by the seat inner shell 9 and the seat outer shell 8 or the seat 1 is provided integrally with a pelvis supporting portion. However, in this description, the seat 1 includes the rising portions of the rear portion of the seat outer shell 8 and the seat inner shell 9 (this is for convenience in description).

In general, the seat 1, the backrest 2 and the connecting portion (that is, support shaft of hinge 17) are disposed at a height near a lower portion of a lumbar area of a person sitting on the seat.

(1)-2. Specifications of Base and Attachment Structure of Seat

As illustrated in FIGS. 4, 5A, 8 and 9, the base 7 has a cylindrical body 21, and an upper plate 22, an intermediate plate 23 and a lower plate 24 are disposed in the cylindrical body 21. The plates 22, 23 and 24 are fixed to the cylindrical body 21 by welding and a bush 25 is fixed to central portions of the plates 22, 23 and 24 by welding. An upper end portion of the leg column 5 is fitted to the bush 25.

Figure 3:
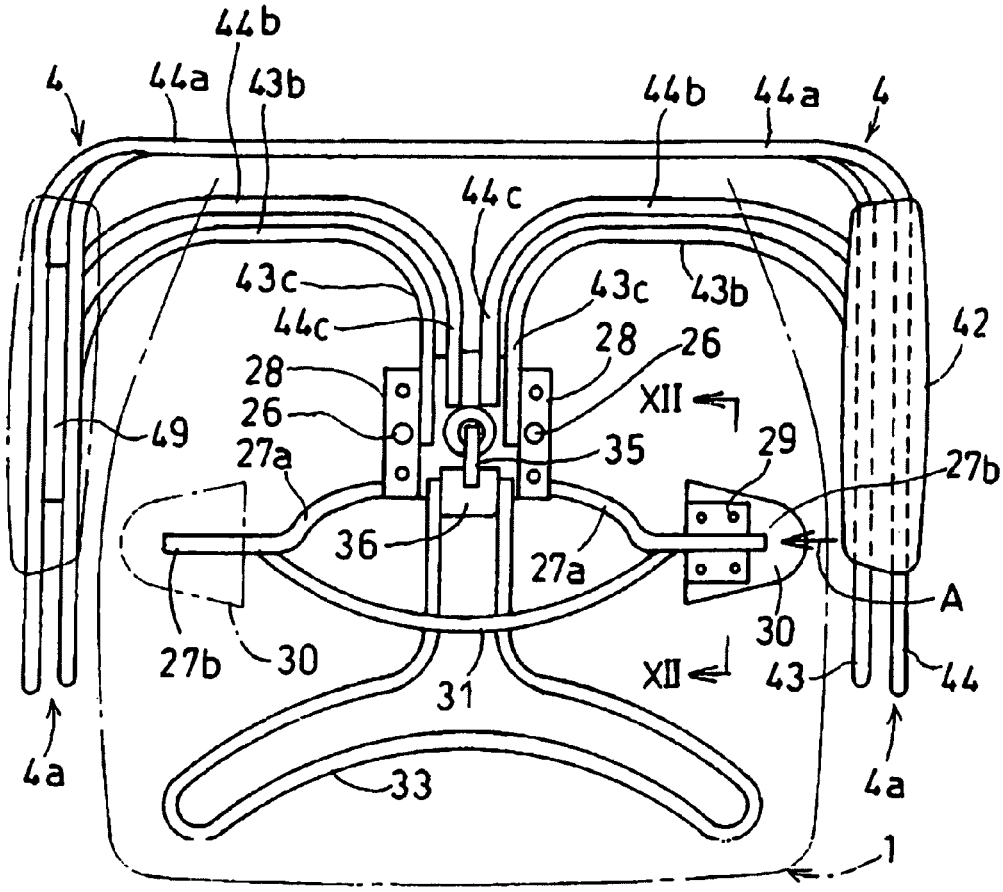
FIG. 3 is a top view illustrating the framework of the chair.
Figure 4:
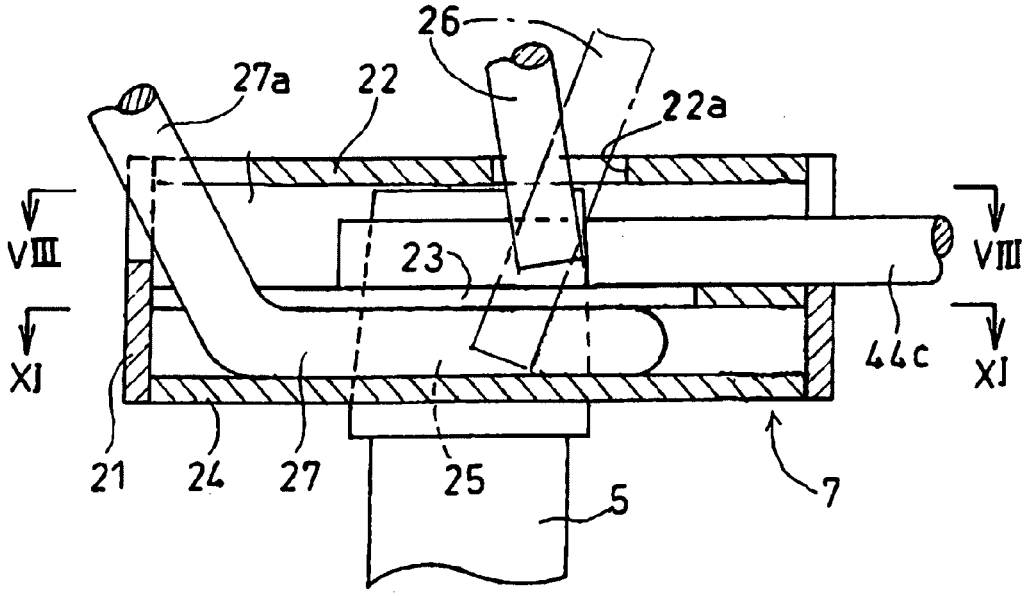
FIG. 4 is a sectional view of a base.

For example, as illustrated in FIGS. 3 and 4, a pair of right and left stopper rods 26, which are vertically long and each of which is partially fitted into the base 7, are disposed under the seat outer shell 8. A horizontal support plate 28 is fixed to the upper end of the stopper rod 26 by welding and the support plate 28 is fixed to the seat outer shell 8 by a machine screw.

Figure 8:
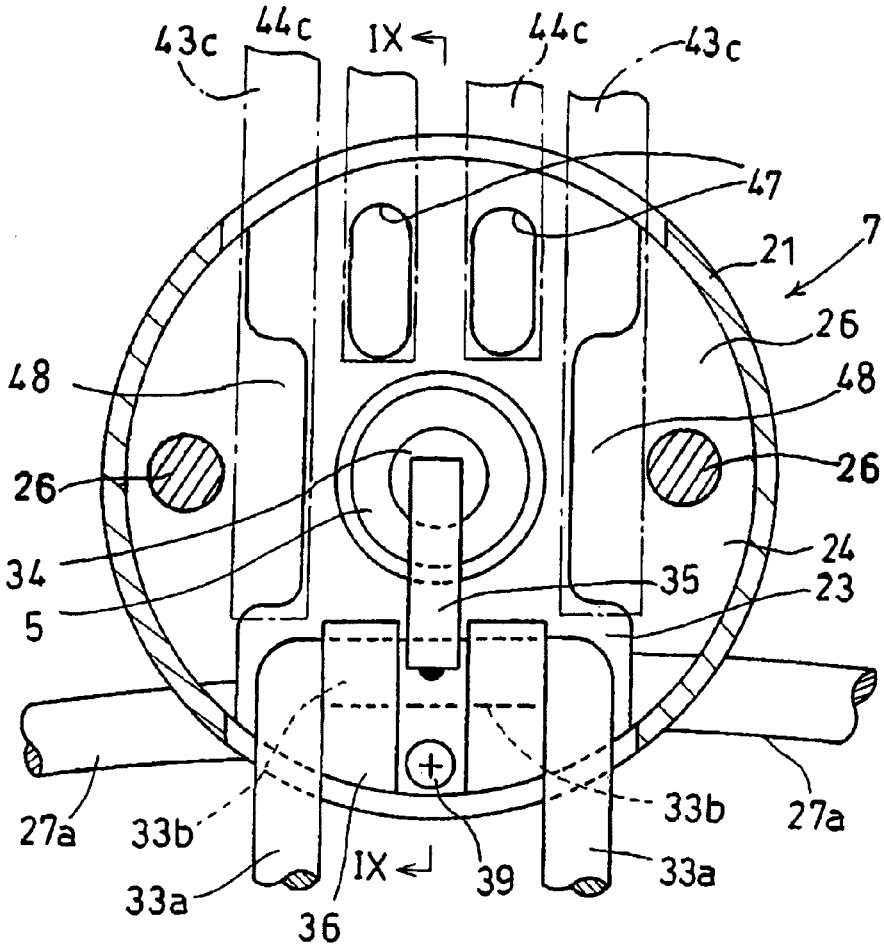
FIG. 8 is a top sectional view taken along the line VIII-VIII in FIG. 4.
Figure 9:
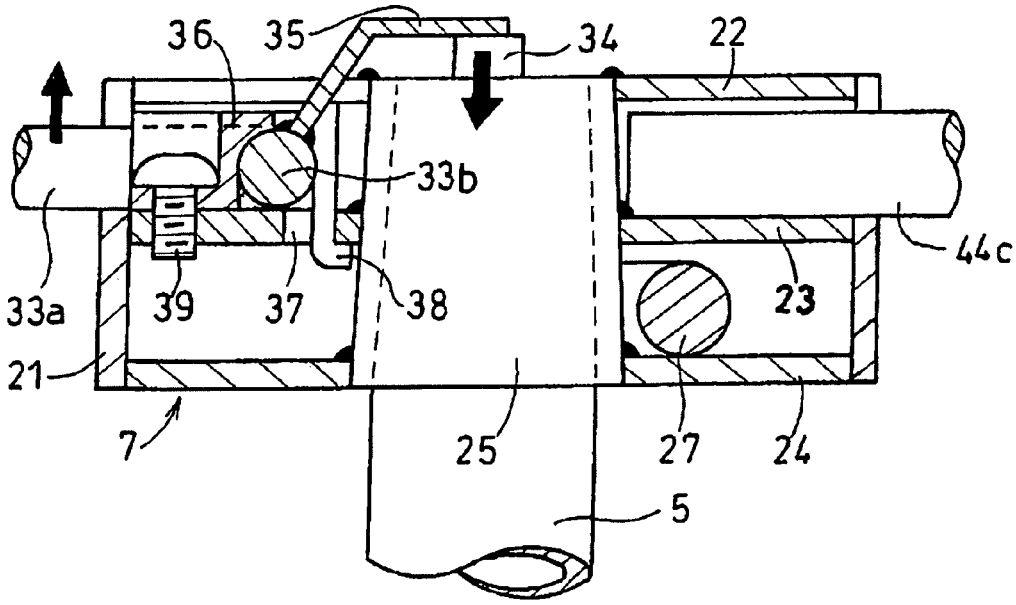
FIG. 9 is a sectional view taken along the line IX-IX in FIG. 8.
Figure 11:
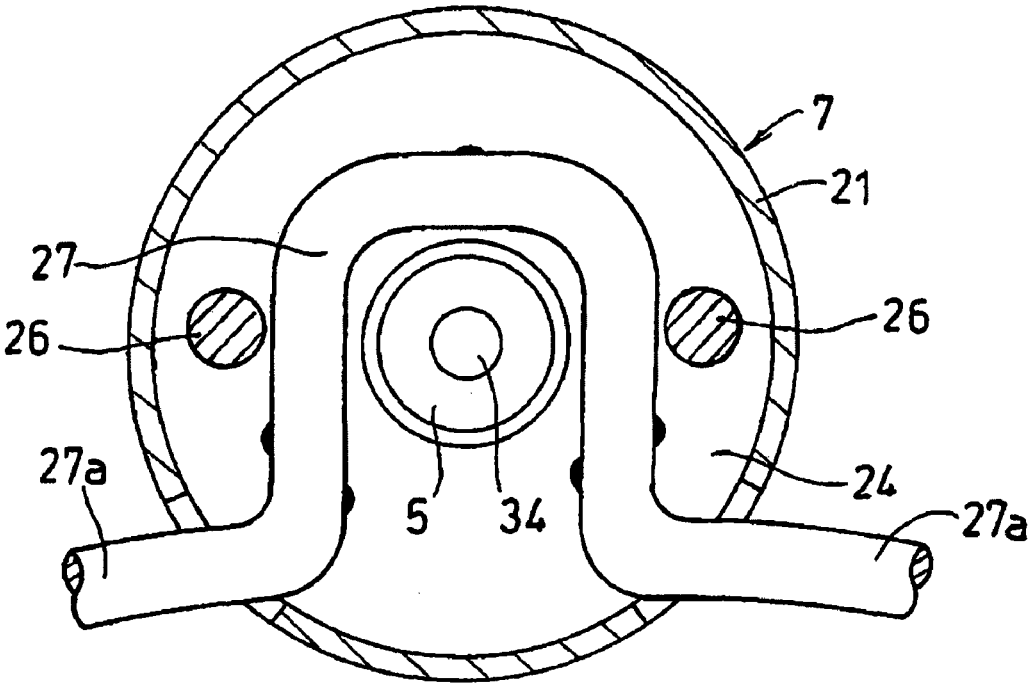
FIG. 11 is a sectional view taken along the line XI-XI in FIG. 4.
Figure 12A:
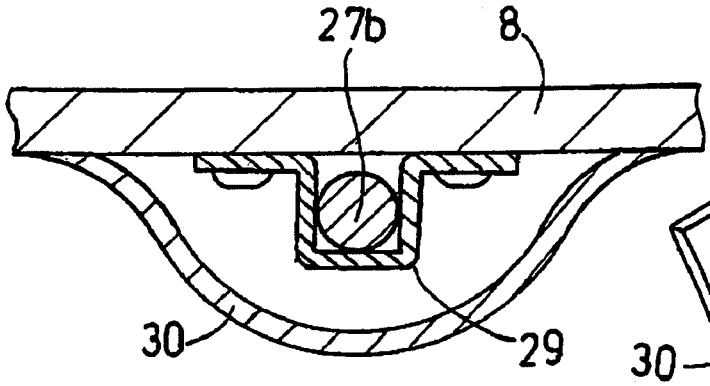
FIG. 12A is a sectional view taken along the line XII-XII in FIG. 3
Figure 12B:
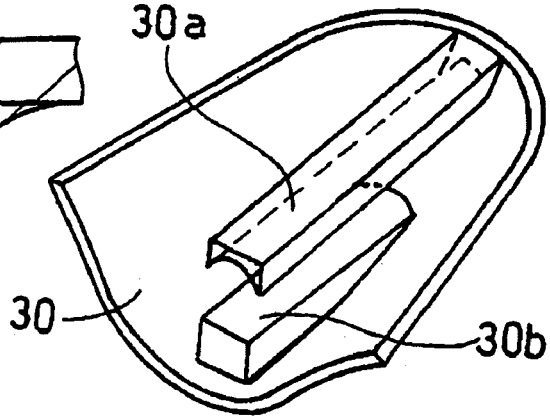
FIG. 12B is a perspective view of a cover.

For example, as illustrated in FIGS. 4, 8 and 11, a seat support 27 surrounding the bush 25 from the right, left and rear sides is fixed to the lower plate 24 of the base 7 by welding (In FIG. 4, an upper face of the seat support 27 overlaps with the intermediate plate 23, but actually, as illustrated in FIG. 9, a gap exists between the seat support 27 and the intermediate plate 23).

The seat support 27 is provided with column portions 27*a* which have a forwardly tilted posture in a side view and rise while extending horizontally in a front view, and the front end of the support portion 27*a* is formed integrally with a horizontal portion 27*b* which faces right and left directions. The horizontal portion 27*b* of the seat support 27 is pressed and held in the seat outer shell 8 by holding pieces 29. The holding piece 29 is covered with a cover 30.

The cover 30 has a cantilever beam-shaped overhanging portion 30*a* fitted between the seat outer shell 8 and the horizontal portion 27*b* and a rib 30*b* overlapping with a lower face of the holding piece 29. As shown by the arrow A in FIG. 3, the cover is attached to the horizontal portion 27*b* by being inserted thereto from the outside and thus a fastening tool such as a machine screw is not required.

In addition, the overhanging portion 30*a* of the cover 30 is firmly inserted between the horizontal portion 27*b* of the seat support 27 and the seat ouster shell 8, and a lower face of the horizontal portion 27*a* of the seat support 27 is brought into contact with a bottom face of the holding piece 29. Accordingly, the seat support 27 is held in the seat outer shell 8 without rattling.

An auxiliary stay 31, which is curved in a forward convex shape in a top view, is fixed to the base of the right and left horizontal portions 27*b* of the seat support 27 by welding. Accordingly, the seat 1 is supported only by the auxiliary stay 31.

The lower end of the rod 26 is a free end. In a non-sitting state, the lower end of the stopper rod 26 is positioned near an upper face of the intermediate plate 23 of the base 7. In addition, the seat 1 resists elastic deformation of the seat support 27 and can be thus tilted backward. When the seat 1 is tilted backward, the stopper rod 26 is dropped, and a maximum backward tilting angle of the seat 1 is restricted by the reach of the stopper rod 26 to the lower plate 24 of the base 7. The upper plate 22 of the base 7 has a long hole 22*a* (see FIG. 4) for allowing the stopper rod 26 to be rotated. The intermediate plate 23 of the base 7 is notched so as not to interfere with the stopper rod 26.

A lever 33 for lifting and dropping the seat 1 is disposed under a front portion of the seat 1. The lever 33 is manufactured by bending one bar (or pipe) and has a shape curved in a forward concave shape (or arched shape) in a top view as a whole. Accordingly, the lever 33 employs a form pulled upward under right and left corner portions of the seat 1. The main reason for employing such a form is that, when lower legs of a person enter under the seat 1, it is avoided that the lower legs reach to the operation lever 33.

(1)-3. Attachment Structure of Lifting and Dropping Operation Lever

Figure 10A:
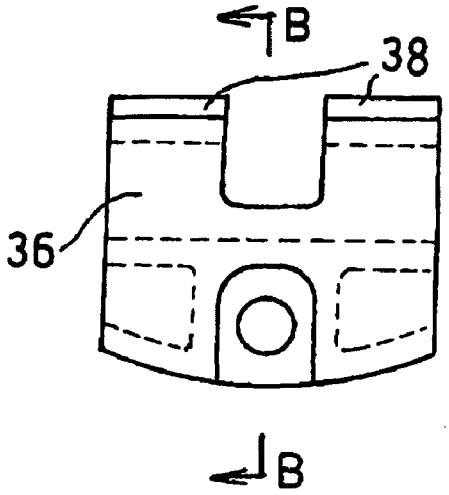
FIG. 10A is a top view of a holding member for a lifting and dropping operation lever and FIG. 10B is a sectional view taken along the line B-B in FIG. 10A.
Figure 10B:
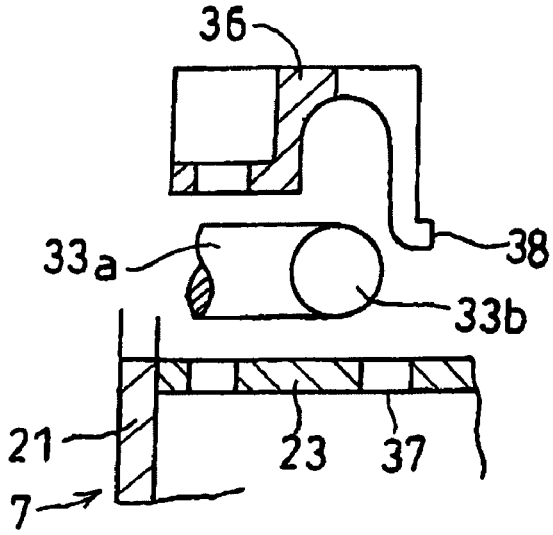

Next, an attachment structure of the operation lever 33 will be described based on FIGS. 8 to 10. The base of the operation lever 33 has a shape almost the same as a U-shape in a top view and has right and left front-rear long portions 33*a* which extend parallel to each other with a gap interposed therebetween and horizontally long horizontal portions 33*b* which are formed so as to be opposed to the right and left front-rear long portions 33*a*, respectively. An operation piece 35 for pushing a push rod 34 of the operating piece leg column 5 is fixed to the right and left horizontally long horizontal portions 33*b* by welding, and the right and left horizontally long horizontal portions 33*b* other than the operation piece 35 are pressed and held in the upper face of the intermediate plate 23 of the base 7 by holding members 36, respectively.

In the holding member 36, right and left middle portions are notched so as not to interfere with the operation piece 35 and a portion pressing the horizontally long horizontal portion 33*b* is bifurcated. A rear end portion of the holding member 36 is provided with a hook 38 which is fitted to a long hole 37 formed on the intermediate plate 23 of the base 7 and hung so as not to move upward. By putting the hook 38 on the edge of the long hole 37 from the lower side, the rear end portion is fixed by one machine screw 39 so as not to be shifted. The holding member 36 is interposed between the front-rear long portions 33*a* of the operation lever 33 from the right and left sides and thus the operation lever 33 is not horizontally shifted.

When a finger is caught on right and left end portions of the operation lever 33 to pull the portions upward, the operation lever 33 is rotated around the horizontally long horizontal portion 33*b*, and thus a bush valve 34 of the leg column 5 is pushed down by the operation piece 35 and the lock of the leg column (gas cylinder) 5 is released. In a non-operation state, the front-rear long portion 33*a* of the operation lever 33 overlaps with the upper face of the intermediate plate 23 of the base 7. Accordingly, the operation lever 33 is held so as not to fall down in the non-operation state.

(1)-4. Frame Device for Back

Next, the back frame devices 4 will be described. The back frame devices 4 have main portions 4*a* which are positioned outside the right and left sides of the seat 1. The main portion 4*a* has a backward tilting portion 4*b* constituting an upper portion with respect to a front end thereof as a boundary and a forward tilting portion 4*c* constituting a lower portion with respect to the front end thereof as a boundary. The whole main portion has a V-shape opened toward the rear side.

A continuous portion (that is, front end portion of main portion 4*a*) of the forward tilting portion 4*c* and the backward tilting portion 4*b* of the main portion 4*a* is curved in an arc shape in a side view. Further, a degree of the tilting of the backward tilting portion 4*b* is smaller than a degree of the tilting of the forward tilting portion 4*c*. The reason of this is that an armrest 42 is attached to the backward tilting portion 4*b*. In addition, the backward tilting portion 4*b* and the forward tilting portion 4*c* are gently curved in a side view so as to form a concave shape toward an opposite direction.

The right and left back frame devices 4 each are composed of unit frames 43 and 44 formed of two round bars, and both of the whole unit frames 43 and 44 extend substantially parallel to each other. In the following description, when it is required to distinguish the two unit frames 43 and 44 from each other, the unit frame close to the seat 1 is referred to as the first unit frame 43 and the unit frame distant from the seat 1 is referred to as the second unit frame 44 with reference to the postures in the main portion 4*a* for convenience. A bar made of metal such as steel, stainless or aluminum can be used as a material for both of the unit frames 43 and 44.

The first unit frame 43 and the second unit frame 44 have upper inward portions 43*a* and 44*a* bent and going behind a back face of the back inner shell 12 from the rear end of the main portion 4*a*, respectively. In this case, the upper inward portion 44*a* of the second unit frame 44 is positioned higher than the upper inward portion 43*a* of the first unit frame 43, and the upper inward portions 44*a* of the right and left second unit frames 44 each are pressed and held in the back inner shell 12 by presser portions (bearing members) 45. The presser portion 45 is fixed to the back inner shell 12 by a machine screw. The upper inward portion 44*a* of the second unit frame 44 can be slightly rotated relative to the presser member 45 and the back inner shell 12.

In this embodiment, the upper inward portions 44*a* of the right and left second unit frames 44 are continuously connected to each other. Thus, the right and left second unit frames 44 are manufactured using one round bar as a material. In this embodiment, since the right and left upper inward portions 44*a* extend in series, there is an advantage in that the tilting of the backrest 2 becomes smooth.

The upper inward portion 43*a* of the first unit frame 43 has a set length so as to abut on or be brought into close contact with the presser member 45. Since the upper inward portion 43*a* is set to have such a length, right-left positioning of the back frame device 4 and the backrest 2 is automatically performed.

It is preferable that the upper inward portion 43*a* of the first unit frame 43 and the upper inward portion 44*a* of the second unit frame 44 are integrally connected to each other by welding or the like. The back outer shell 11 overlaps with the back face of the back inner shell 12. Accordingly, in order to prevent the upper inward portions 43*a* and 44*a* of the unit frames 43 and 44 to interfere with the presser member 45, a backward protruding portion 11*a* curved in a mountain shape is formed to be bent in the back outer shell 11. A tunnel-shaped space is generated between the back outer shell 11 and the back inner shell 12 by forming the backward protruding portion 11*a* and this space can be sealed with a cap 46 illustrated in FIGS. 7C and D.

For example, as illustrated in FIG. 3, the first unit frame 43 and the second unit frame 44 are provided with lower inward portions 43*b* and 44*b*, which are horizontally long and go under the seat 1 while being continuously connected to the rear end of the front tilting portion 4*c* of the main portion 4*a*, respectively. In back of the base 7, the lower inward portions 43*b* and 44*b* go under the seat 1 and the front ends of the lower inward portions 43*b* and 44*b* are integrally connected to forward end portions 43*c* and 44*c*. The forward end portions 43*c* and 44*c* are fixed to the intermediate plate 23 of the base 7 by welding. In this embodiment, the lower connecting portion described in the claims includes the lower inward portions 43*b* and 44*b* which are horizontally long and the forward end portions 43*c* and 44*c*.

Needless to say, a cylindrical body 21 of the base 7 is notched so as not to interfere with the forward end portions 43*c* and 44*c*. As illustrated in FIG. 8, long holes 47 and notched portions 48 overlapping with the forward end portions 43*c* and 44*c* in a top view are formed in the intermediate plate 23 of the base 7 and this is a measure for facilitating overlaying upon welding of the forward end portions 43*c* and 44*c*.

In this embodiment, the lower inward portion 43*b* and the forward end portion 43*c* of the first unit frame 43 are surrounded by the lower inward portion 44*b* and the forward end portion 44*c* of the second unit frame 44 from the outside. This is because the forward end portions 43*c* and 44*c* are disposed at the same height. By changing the heights of the forward end portions 43*c* and 44*c*, the forward end portions 43*c* and 44*c* can achieve a posture overlapping with each other in a top view and can be fixed to a side face of the base 7.

The first unit frame 43 and the second unit frame 44 are set to be at different heights so that the first unit frame 43 is lower than the second unit frame 44 at a position in the backward tilting portion 4*b* of the main portion 4*a*. In addition, as illustrated in FIG. 5B, a plate member 49 having a posture tilted in a front view is fixed to the first unit frame 43 and the second unit frame 44 of the backward tilting portion 4*b* by welding and the armrest 42 is fixed to the plate member 49.

Since the plate member 49 is tilted in a front view, an upper face of the armrest 42 is tilted downward toward the seat 1 in a front view. Accordingly, when a person sitting on the seat outstretches his arms and puts each elbow on the armrest 42, the arms are put from a direction substantially perpendicular to the upper face of the armrest 42 as shown by the arrow B in FIG. 5B and thus the elbows can be stably held. The armrest 42 is separated into two upper and lower members 42*a* and 42*b* and the upper and lower members 42*a* and 42*b* are fastened by screws (not shown) passing through the plate member 49.

(1)-5. Conclusion

When a person sitting on the seat leans on the backrest 2, a large moment is applied to an upper portion of the backrest 2 and thus the backrest 2 is largely tilted backward around the hinge 17 by elastic deformation of the back frame device 4.

Further, states, specifically, a state "a" in which since the back frame device 4 has a long length and a substantially V-shape in a side view, the back frame device is easily deformed, a state "b" in which since the lower inward portions 43*b* and 44*b* are present under the back frame device 4, an action (torsion action) is applied to the lower inward portions 43*b* and 44*b* to screw them around axes thereof, and thus the back frame device 4 is largely and easily deformed in a direction so that the backward tilting angle of the backrest 2 increases, and a state "c" in which the screwing action and the bending action are also applied to the forward end portions 43*c* and 44*c* and thus they are allowed to be deformed, are given, and the back frame device 4 is largely elastically deformed with the combination of the states a to c. As a result, the backrest 2 can be largely tilted backward.

The back frame device 4 is composed of two inner and outer unit frames 43 and 44. Since both of the unit frames 43 and 44 have different lengths and are disposed at different heights, the unit frames 43 and 44 are deformed in different manners and deformation occurs with mutual restriction. That is, a phenomenon in which one of the unit frames 43 and 44 is deformed while the other acts as resistance occurs.

In this case, the sum of the elastic deformation of the two unit frames 43 and 44 becomes resistance to the backward tilting of the backrest 2 and the forward advance of the seat 1. The unit frames 43 and 44 restrict each other as the degree of the deformation increases, and thus an increasing rate of the elastic restoring force of the unit frames 43 and 44 as a whole is higher than an increasing rate of the backward tilting angle of the backrest 2. As a result, the backrest 2 is not steeply tilted backward. The backrest is tilted backward with an appropriate resistance force. In this manner, the chair of this embodiment can provides a comfortable feeling upon rocking.

In this embodiment, the seat 1 is tilted backward and either one of the following two modes, specifically, a mode in which the seat is initially tilted backward since a person sitting on the seat leans on the backrest 2 and a mode in which the seat is slightly tilted backward since a person sits on the seat, can be selected as the backward tilting mode of the seat 1. The mode is determined depending on the setting of the strength (elastic restoring force) of the seat support 27.

Second Embodiment

Figure 13:
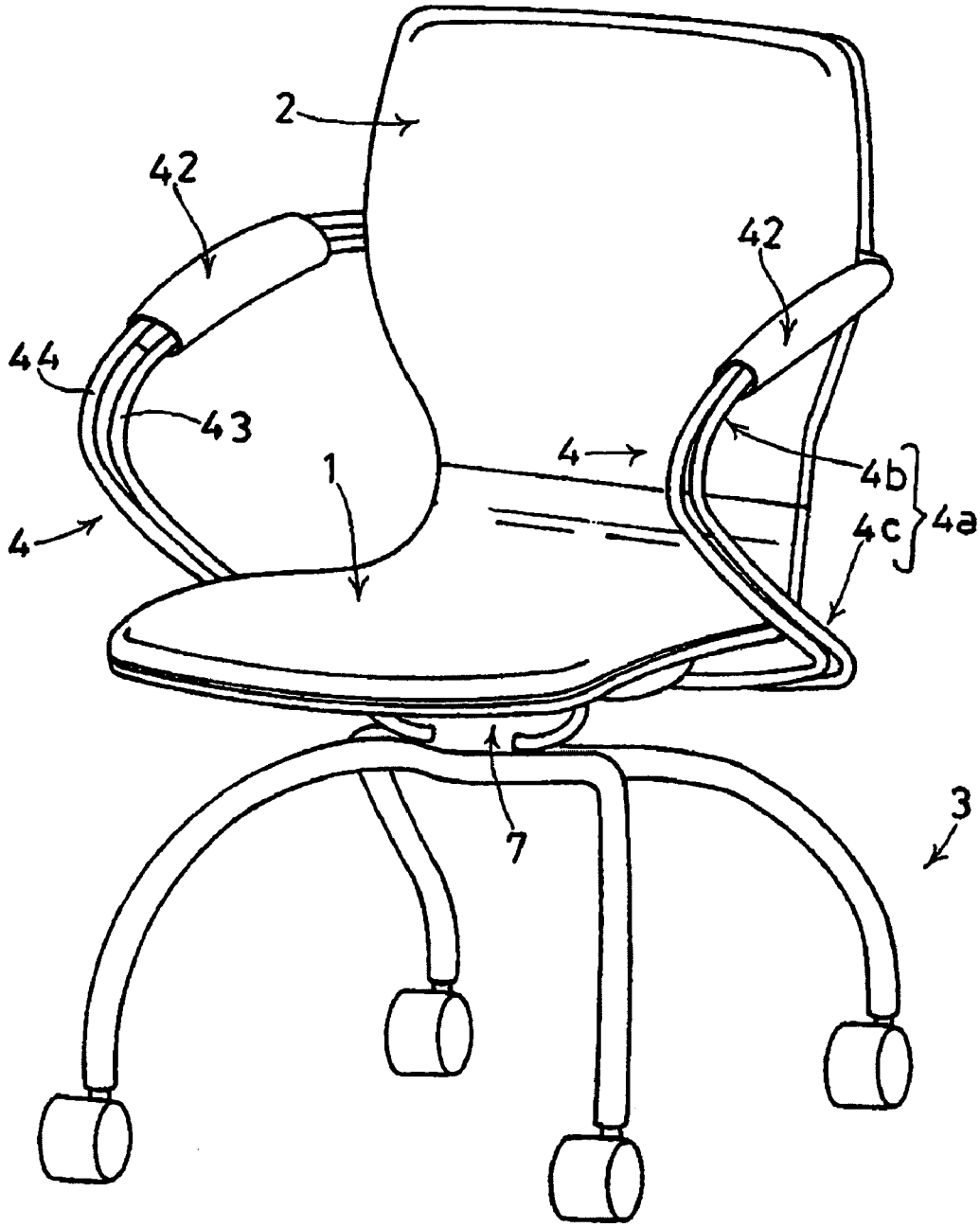
FIG. 13 is a perspective view of a chair of a second embodiment.
Figure 14:
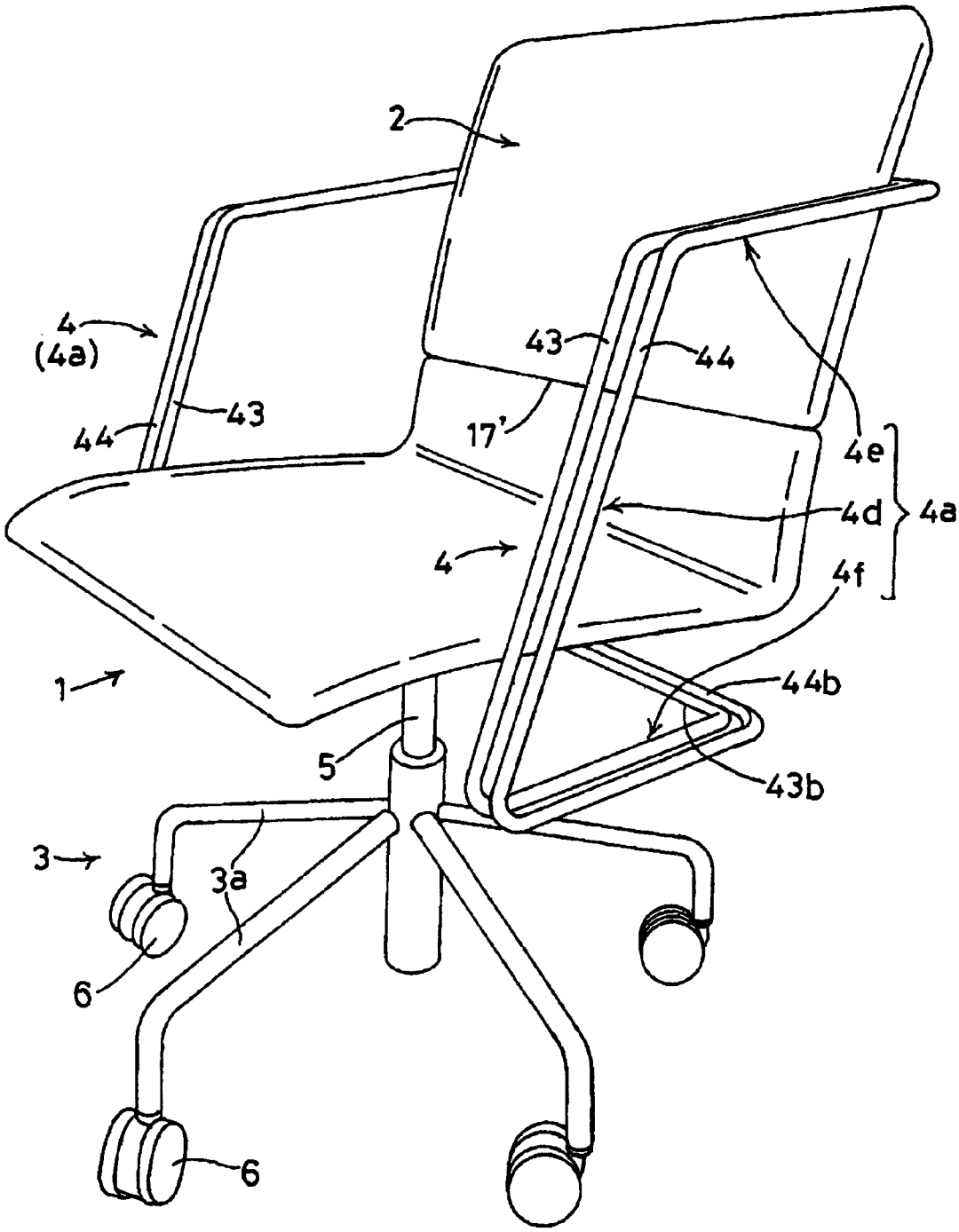
FIG. 14 is a perspective view of a chair of a third embodiment.

FIG. 13 illustrates a second embodiment. In this embodiment, a leg 3 has a four leg-type frame structure. The portions disposed above the base 7 are essentially the same as them of the first embodiment. However, the lifting and dropping operation lever 33 of the first embodiment is not provided (in this second embodiment, the lifting and dropping operation lever is not required).

In the case where the leg 3 has a frame structure composed of pipes or bars, various types are conventionally proposed. The present invention can be applied to any conventional leg and can be also applied to newly manufactured legs.

Third Embodiment

FIGS. 14 to 17 illustrate a third embodiment. This embodiment has the same basic configuration as that of the first embodiment and there are differences in details. Hereinafter, a description will be given. Descriptions for the same parts as those of the first embodiment will be omitted if not particularly necessary.

In this embodiment, a seat 1 and a backrest 2 have a structure in which substrates 1*a* and 2*a* such as synthetic resin or plywood are covered with cushion members 1*b* and 2*b*, respectively, and the substrate 1*a* and 2*a* of the seat 1 and the backrest 2 are integrally connected to each other (the substrates 1*a* and 2*a* correspond to the outer shells 8 and 11 of the first embodiment, respectively). The backrest 2 is bent in a side view around a bending point 17' (fold) positioned at a height near a waist of a person sitting on the seat.

Figure 17:
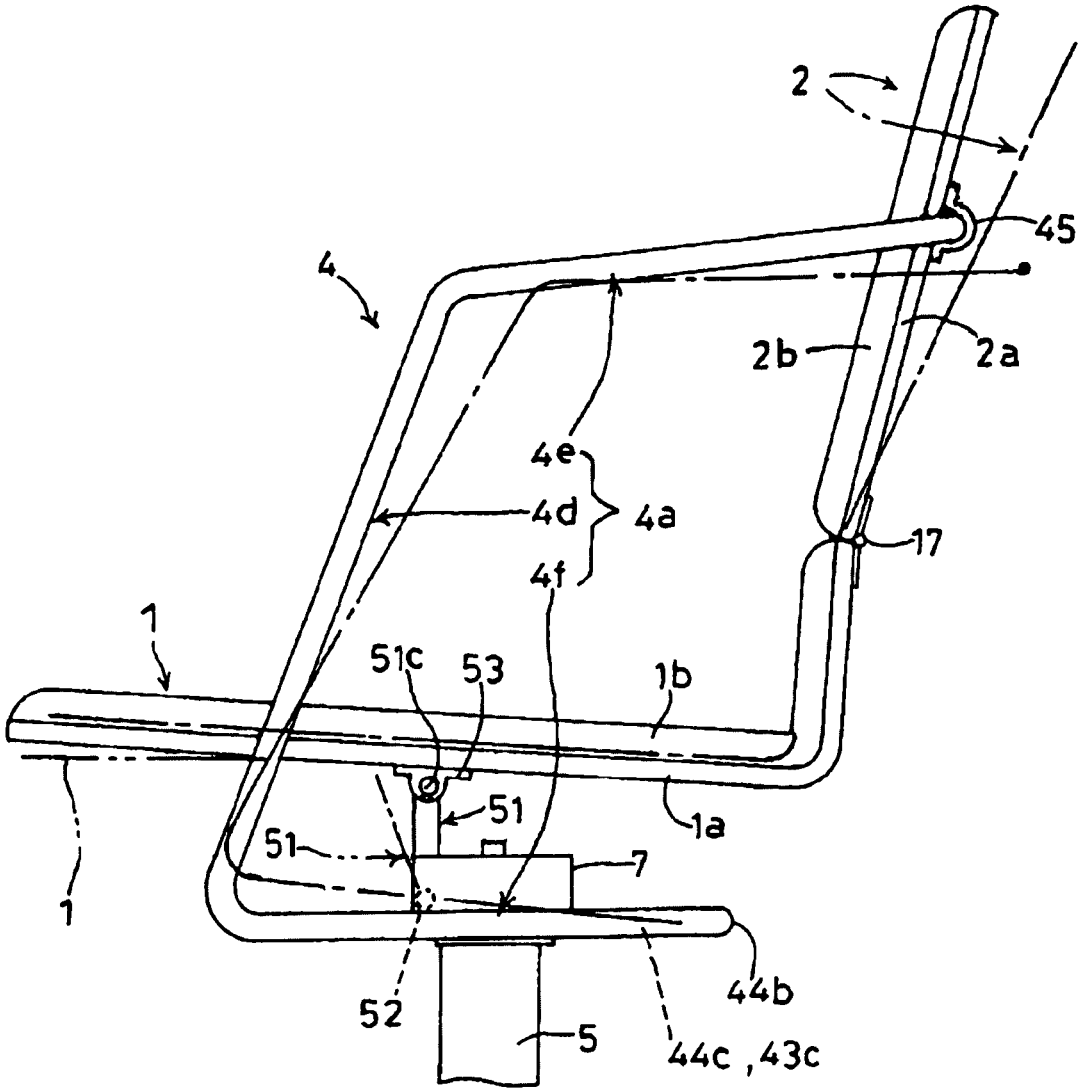
FIG. 17 is a view illustrating the movement of the chair.

As a method of bending the backrest 2, as illustrated in FIG. 17, the substrate 2*a* may be separated into upper and lower portions to connect both of the portions to each other by a hinge 17 or a pin, or the substrate 2*a* may be made of a flexible material such as resin to form a thin hinge portion.

Figure 15:
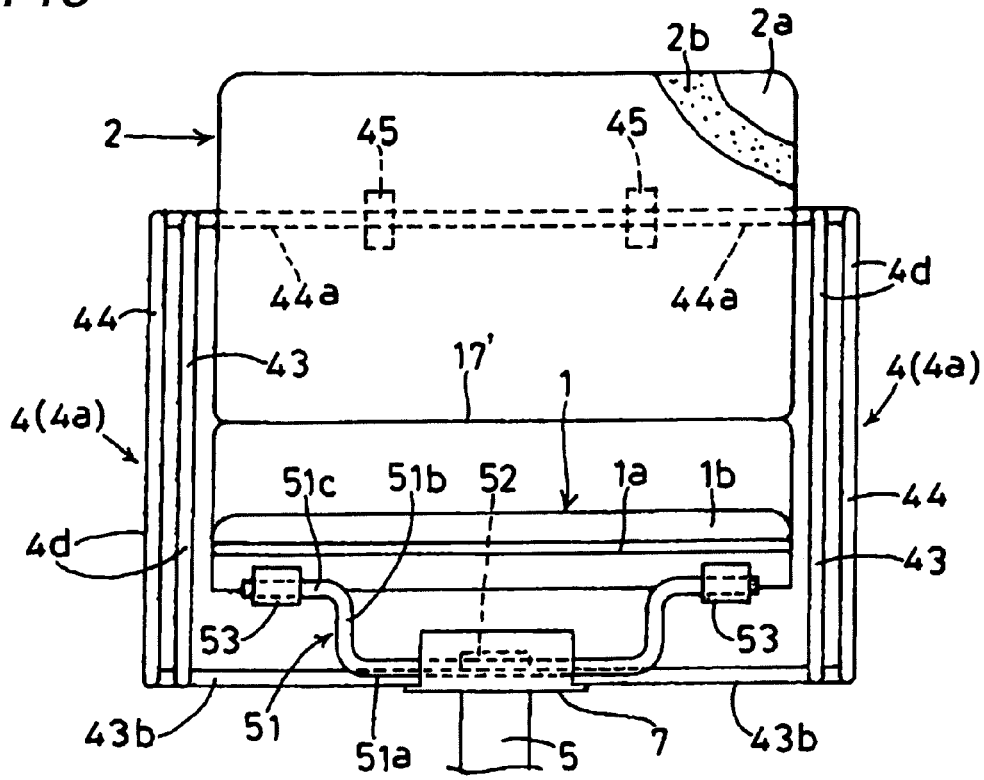
FIG. 15 is a front view of the chair.
Figure 16:
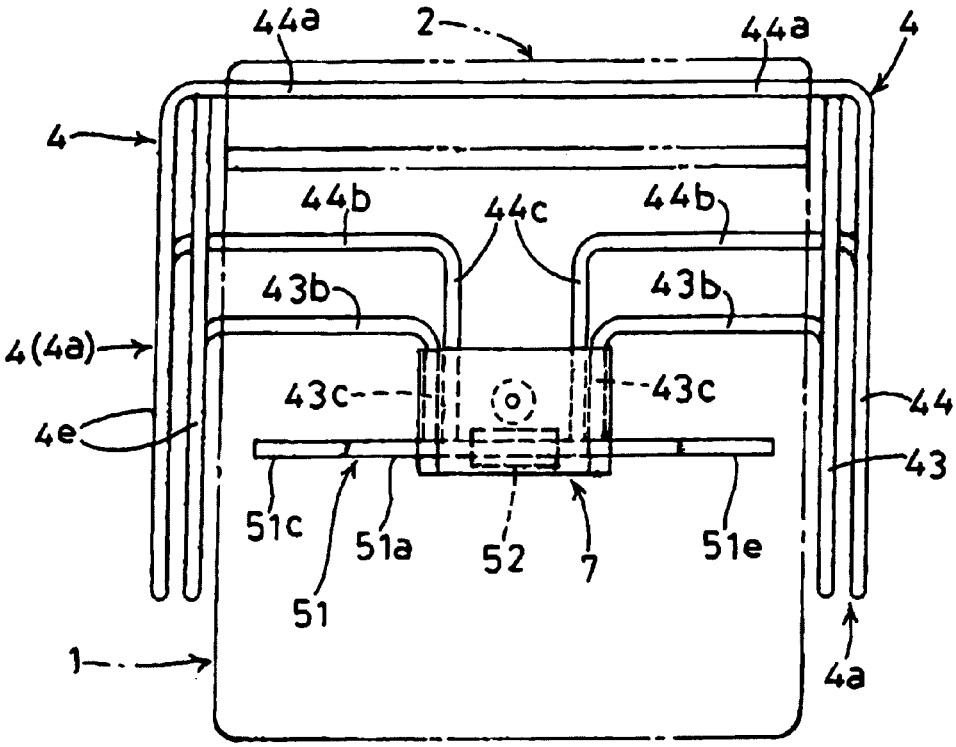
FIG. 16 is a top view illustrating the framework of the chair.

As illustrated in FIGS. 15 to 17, the seat 1 is attached to seat frames 51 attached to a base 7. The seat frames 51 are formed in a substantially crank shape with lower horizontal portions 51*a* which are horizontally long in a front view, vertically long portions 51*b* which are formed to be bent at opposite ends of the lower horizontal portions, and right and left upper horizontal portions 51*c* which are formed at opposite ends of the vertically long portions. The lower horizontal portion 51*a* is fixed to the base 7 or attached to be rotatable relative to the base 7 via a lower bearing member 52. The upper horizontal portion 51*c* of the seat frame 51 is attached to be rotatable relative to a lower face of the seat 1 by an upper bearing member 53. Accordingly, when the seat frame 51 is rotated around the upper horizontal portion 51*a*, the seat 1 can slide forward and backward.

First and second unit frames 43 and 44 are provided with column portions 4*d* rising in a vertical direction in a front view on the right and left sides of the seat 1, upper portions 4*e* extending backward while being continuously connected to the upper ends of the right and left column portions 4*d*, and lower portions 4*f* which are horizontal in a side view and extend backward while being continuously connected to the lower ends of the right and left column portions 4*d*. By the column portion 4*d*, the upper portion 4*e* and the lower portion 4*f*, a main portion 4*a* opened toward the rear side is configured.

Lower inward portions 43*b* and 44*b* which are horizontally long extend continuously from the rear ends of the lower portions 4*f* and forward end portions 43*c* and 44*c* are formed integrally with the front ends of the lower inward portions 43*b* and 44*b*. The forward end portions 43*c* and 44*c* are fixed to the base 7 by welding.

Moreover, the rear end of an upper portion 4*e* of the second unit frame 44 is integrally connected to one upper inward portion 44*a* extending along a back face of a portion near the upper end of the backrest 2 and the upper inward portion 44*a* is connected to the back face of the backrest 2 by presser members 45 to be relatively rotated. The upper portion 4*e* of the first unit frame 43 is fixed to the upper inward portion 44*a* of the second unit frame 44 by welding.

The upper inward portion disposed inside the backrest 2 may be made of a different member from that for both of the unit frames 43 and 44 and the upper portions 4*e* of the unit frames 43 and 44 may be fixed to the upper inward portion by welding or the like. Furthermore, the first unit frame 43 may be provided with an upper inward portion 43*a* which is formed to be bent.

As illustrated in FIGS. 15 and 16, the second unit frame 44 and the first unit frame 43 extend substantially parallel to each other in a top view and in a front view, except the upper inward portion 44*a*.

In this embodiment, when the seat frame 51 is fixed to the base 7, the seat 2 only moves forward upon rocking. On the other hand, when the seat frame 51 is connected to the base 7 to be tiltable, the seat 1 moves forward upon rocking. In addition, the front end of the seat 1 may be dropped by forward movement (that is, forward tilting).

A function of the back frame device 4 is essentially the same as that of the first embodiment. However, it can be said that since a length of the back frame device 4 is longer than that of the first embodiment and the first unit frame 43 and the second unit frame 44 are not connected to each other in the main portion 4*a*, deformation occurs more easily in this embodiment than in the first embodiment.

Fourth Embodiment

Figure 18:
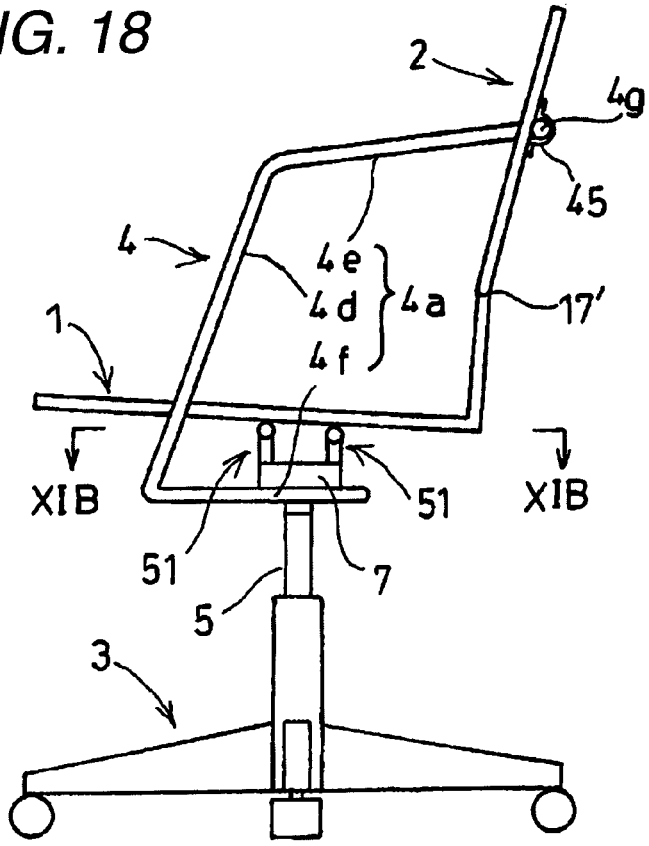
FIG. 18 is a side view of a chair of a fourth embodiment.
Figure 19A:
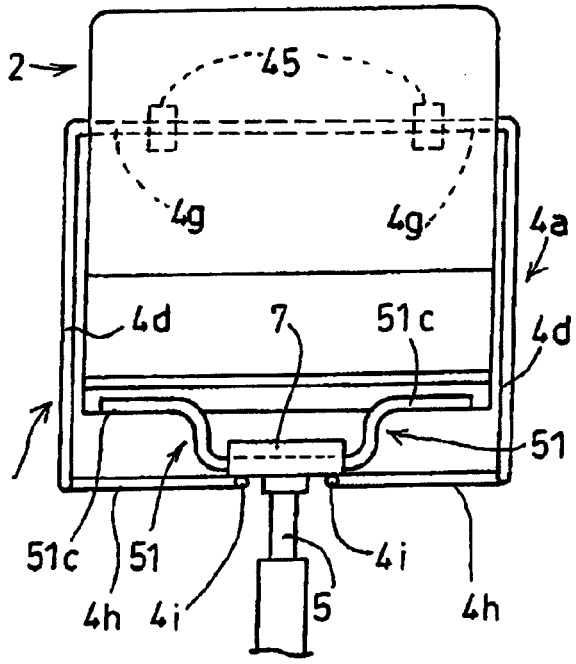
FIG. 19A is a front view of the fourth embodiment and FIG. 19B is a top view taken along the line XIXB-XIXB in FIG. 18.
Figure 19B:
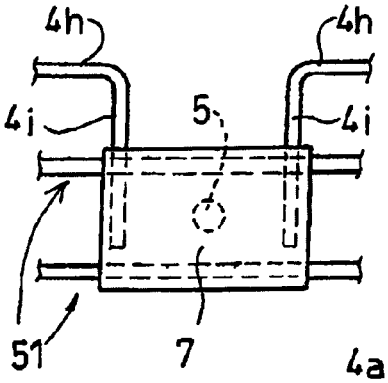

FIGS. 18 and 19 illustrate a fourth embodiment. In this embodiment, a back frame device is formed of one member. Since a shape of a back frame device 4 is almost the same as in the third embodiment, the same reference signs as in the third embodiment are given and details will be omitted. An upper inward portion is represented by reference sign 4*g*, a lower inward portion is represented by reference sign 4*h*, and a forward end portion is represented by reference sign 4*i*. In the relationship with the above-described embodiments, the reference sign 4*g* corresponds to the reference signs 43*a* and 44*a*, the reference sign 4*h* corresponds to the reference signs 43*b* and 44*b*, and the reference sign 4*i* corresponds to the reference signs 43*c* and 44*c*.

In this embodiment, a pair of front and rear seat frames 51 is disposed. The seat frame 51 may be fixed to a base 7 and may be connected to the base 7 to be tiltable. The forward end portion 4*i* of the back frame device 4 is fixed to a lower face of the base 7.

(5). Others

The present invention can be embodied in various forms other than the above embodiments. For example, a forward end portion of a lower connecting portion of a back frame device is tiltable in a top view. That is, for example, tilting can be achieved so that right and left spaces of right and left forward end portions become wider as being close to the rear side. In addition, the lower connecting portion may be formed in an arc shape in a top view.

Furthermore, when a main portion of a back frame device is formed in a substantially V-shape in a side view, an upper face or a lower face thereof may be formed in a horizontal shape. The main portion of the back frame device may be also formed in a U-shape opened toward the rear side in a side view.

In this description, it is disclosed that the back frame device is composed of a plurality of the unit frames and the connecting portion of the back support frame is provided with the end portion extending in substantially front and rear directions, and these can be embodied as independent inventions.

The invention claimed is:

1. A chair comprising:

a base;

a seat supported by the base;

a backrest which is backwardly tiltable; and right and left back frame devices each including a main portion positioned outside right and left sides of the seat, each of the right and left back frame devices comprising two unit frames formed of bars or pipes, the two unit frames having different lengths and disposed at different heights, wherein the tilt of the backrest is supported by the back frame devices and is allowed by elastic deformation of the back frame devices; and each of the main portions has a shape opened toward a rear end in a side view and comprises:

an upper connecting portion to which the backrest is attached, positioned at an upper rear end of each of the main portions; and a lower connecting portion which goes under the seat, integrally formed with a lower rear end of each of the main portions, wherein the lower connecting portion has an end portion extending to a front side; and the end portion is fixed to the base or the seat.

2. The chair according to claim 1, wherein upper inward portions which extend along a back face of the backrest are formed to be bent at the upper rear ends of the main portions of the right and left back frame devices, respectively, and the upper inward portions serve as the upper connecting portion.

3. The chair according to claim 2, wherein the backrest has a back inner shell of which a front face is covered with a cushion and a back outer shell which is disposed on the back side of the back inner shell, and the upper inward portion of each back frame device is disposed between the back inner shell and the back outer shell.

4. The chair according to claim 3, wherein the back outer shell of the backrest is formed of a wooden plate, and in the back outer shell, a backward protruding portion for avoiding the interference with the upper inward portion of each back frame device is formed to be bent and extends over the entire horizontal length, and wherein the seat has a seat outer shell which is formed of a wooden plate and a seat inner shell which is disposed on an upper face of the seat outer shell and covered with a cushion, and the seat outer shell and the back outer shell have substantially the same thickness and extend to be continuously connected to each other in a side view.

5. The chair according to claim 1, wherein a rising portion which can support a waist of a person sitting on the seat is formed at a rear end of the seat, and the backrest is connected to an upper end of the rising portion of the seat so as to be tiltable backward.

6. The chair according to claim 1, wherein the seat is supported by the base in a state of being tiltable backward, and the back frame device is fixed to the base.

7. The chair according to claim 1, wherein the two unit frames extend substantially parallel to each other in the main portion in a top view and in a front view, and an armrest is attached to an upper portion of the main portion.

8. The chair according to claim 7, wherein the unit frame close to the seat is lower than the unit frame distant from the seat in the portion to which the armrest is attached, and thus an upper face of the armrest has a posture obliquely tilted downward toward the seat in a front view.

9. The chair according to claim 1, wherein the main portion of each back frame device has a portion which constitutes an upper portion with respect to a front end thereof as a boundary and is tilted backward in a side view and a portion which constitutes a lower portion with respect to the front end thereof as a boundary and is tilted substantially forward in a side view, and the portion tilted backward and the portion tilted forward in a side view are smoothly and continuously connected to each other via a front end portion having an arc shape in a side view, and thus the whole main portion has a substantially horizontal V-shape.

10. The chair according to claim 1, further comprises a seat support connecting the seat and the base.

11. The chair according to claim 10, wherein the seat support is connected to the seat at a front side relative to the base.

12. The chair according to claim 1, wherein only one of the two unit frames is rotatably attached to the backrest by a presser member behind the backrest.

13. A chair comprising:

a base;

a seat supported by the base;

a backrest which is backwardly tiltable; and right and left back frame devices each including a main portion positioned outside right and left sides of the seat, wherein the tilt of the backrest is supported by the back frame devices and is allowed by elastic deformation of the back frame devices; and each of the main portions has a shape opened toward a rear end in a side view and comprises:

an upper connecting portion to which the backrest is attached, positioned at an upper rear end of each of the main portions;

a lower connecting portion which goes under the seat, integrally formed with a lower rear end of each of the main portions, wherein the lower connecting portion has an end portion extending from a rear side toward a front side, and the end portion is fixed to the base or the seat.

14. The chair according to claim 13, wherein the lower connecting portion goes under the seat from a lateral side of the seat at a position rearward of the base.

* * * * *